United States Patent [19]

Martellock

[11] 4,018,953

[45] Apr. 19, 1977

[54] COATING METHOD

[75] Inventor: Arthur C. Martellock, Pittsford, N.Y.

[73] Assignee: Xerox Corporation, Stamford, Conn.

[22] Filed: Aug. 12, 1976

[21] Appl. No.: 713,764

[52] U.S. Cl. ..... 427/430 R; 118/404

[51] Int. Cl.[2] ..... B05D 1/00; B05C 3/02

[58] Field of Search ..... 118/405, 407, 409, 410, 118/DIG. 11, 404; 427/434 R, 434 D, 430 R, 430 A, 430 B, 439–443; 96/144

[56] References Cited

UNITED STATES PATENTS

| | | | |
|---|---|---|---|
| 2,482,021 | 9/1949 | Mickelson | 118/DIG. 11 |
| 2,545,792 | 3/1951 | Perrault | 118/DIG. 11 |
| 3,117,028 | 1/1964 | Kaulen | 118/407 X |
| 3,188,371 | 6/1965 | Weekley | 118/407 X |

FOREIGN PATENTS OR APPLICATIONS

| | | | |
|---|---|---|---|
| 1,314,146 | 11/1962 | France | 427/435 |
| 173,774 | 4/1935 | Switzerland | 427/430 R |
| 454,551 | 6/1968 | Switzerland | 427/434 R |

*Primary Examiner*—Morris Kaplan
*Attorney, Agent, or Firm*—James J. Ralabate; James P. O'Sullivan; Jerome L. Jeffers

[57] ABSTRACT

Disclosed is a method for applying a thin layer of a hardenable, liquid material to the surface of a cylindrical substrate. The method involves mounting a coating collar, which is a ring having an inside diameter larger than the outside diameter of the cylinder with a resilient gasket centrally situated therein, on the substrate by sliding it over one end thereof. The ring, gasket and cylinder form a leak-proof trough when the collar is mounted in this manner. The liquid is poured into the trough while the cylinder is in a vertical position and the liquid is applied to the cylinder by sliding the collar down the outside of it to thereby leave a thin coating of the liquid on the outer surface of the cylinder.

7 Claims, 3 Drawing Figures

COATING METHOD

BACKGROUND OF THE INVENTION

This invention relates to a novel method for the application of a thin layer of a hardenable liquid to the outer surface of a cylinder. While not limited thereto, the method has special applicability for the application of a protective overcoating material to electrostatographic photo-receptors. The art of electrostatographic copying, originally disclosed by C. F. Carlson in U.S. Pat. No. 2,297,691, involves, as an initial step, the uniform charging of a plate or drum comprised of a conductive substrate normally bearing on its surface a non-conductive barrier layer which is covered by a layer of photoconductive insulating material. The charged plate is exposed to activating radiation in imagewise configuration which results in dissipation of the electrostatic charge in the exposed areas while the non-exposed areas retain the charge in a pattern known as the latent image. The latent image is developed by contacting it with an electroscopic marking material commonly referred to as toner. This material is electrically attracted to the latent image which is, by definition, in the configuration of those portions of the photoreceptor which were not exposed to the activating radiation. The toner image may be subsequently transferred to paper and fused to it to form a permanent copy. Following this, the latent image is erased by discharging the drum and excess toner is cleaned from it to prepare it for the next cycle.

The photoconductive insulating material is characterized in that it has a comparatively high electrical resistance in the dark which resistance decreases significantly upon exposure to activating radation. Both organic materials, such as 2,4,7-trinitro-9-fluorenone in poly(vinylcarbazole), and inorganic materials, such as amorphous selenium, have been successfully used as the photoconductive material in electrostatographic copiers.

In some instances, it has been found to be desirable to overcoat the layer of photoconductive insulating material with a thin layer of an organic material. These overcoatings are applied for a variety of reasons. One reason for using an overcoating is to protect the photoconductive material from physical abrasion during the copying cycle. Overcoatings of this type are disclosed in U.S. Pat. No. 2,860,040 (where polyvinylacetal or polyvinylformal are used) and U.S. Pat. No. 2,886,434 (where inorganic materials such as ZnS, $SiO_2$ and $TiO_2$ are used). In certain instances, an overcoating material is applied to the layer of photoconductive material to enhance its cleanability. An example of this type of overcoating is to be found in U.S. Pat. No. 3,793,018 wherein it is disclosed that a hydrophobic bivalent or trivalent metal salt of a half ester of a branched chain or straight chain aliphatic dicarboxylic acid of a mono- or di-ester of a phosphorous oxyacid can be applied to the photoreceptor. Still another use of an overcoating is to protect the photoconductive material from chemical constituents in the ambient which may detrimentally react with it. Copending application Ser. No. 558,027 discloses this type of overcoating. In addition, certain polymeric overcoatings have been found to increase the electrophotographic speed of the photoreceptor. Many of these overcoating materials are applied from their liquid solutions or dispersions. Application of the solution or dispersion with subsequent evaporation of the liquid leaves a thin layer of the overcoating material on the outer surface of the cylinder. When an organic polymeric material is used as the overcoating, it is typically applied from a synthetic latex, i.e. a finely divided emulsion of polymer particles in an aqueous carrier. The carrier normally contains a basic material such as ammonia or an amine, e.g. isopropylamine, to form a salt with weakly ionized carboxylic acid groups on the polymer backbone and thereby increase the solubility of the polymer. Evaporation of the water leaves a thin layer of the polymer.

In order to get a polymer layer of uniform thickness it is, of course, necessary to apply a layer of the dispersion uniformly. One method of applying the liquid to the cylinder involves applying a wetted sponge to the cylinder's surface and rotating the cylinder about its axis of rotation while moving the wetted sponge laterally along the cylinder. This method can be effective in applying a uniform coating but requires a fairly high level of operator skill, especially when the liquid is of the type which hardens rapidly. Another method is to apply the hardenable liquid to the cylinder with a spray gun and allowing it to drain and dry. This method is quite wasteful of material, however, since enough liquid must be applied so all the bubbles generated by the spray drain off.

It would be deisrable, and it is an object of the present invention, to provide a novel process for the application of a thin, uniform layer of a hardenable liquid to the surface of cylindrical substrate.

A further object is to provide such a process which is relatively easy to carry out and employs simple, inexpensive equipment.

An additional object is to provide such a method which is economical in terms of coating liquid consumption.

SUMMARY OF THE INVENTION

The present invention involves a method of applying a thin coating of a hardenable, liquid material to the surface of a cylindrical substrate. The method comprises:

a. mounting the cylindrical substrate, in vetical disposition, on a vertically elongated pedestal having the same diameter as that of the cylinder;

b. providing an applicator collar comprising a ring having an inside diameter larger than the outside diameter of the cylinder, said ring having along its inside surface a resilient ring-shaped gasket attached to the ring in such a manner that a leakproof trough is formed when the collar is slideably mounted on the cylinder by sliding it over one end thereof and providing guide fingers depending from said ring whereby to maintain said collar in a perpendicular relationship with the cylinder's axis;

c. mounting the coating collar on the outside of the cylinder by sliding it over an end thereof;

d. adding the hardenable liquid to the trough formed by the ring, gasket and cylinder while the cylinder is in a vertical position; and e. sliding the applicator collar down the full length of the cylinder and onto the pedestal to leave a thin coating of the liquid on the outer surface of the cylinder.

The method of practicing the present invention is more fully illustrated by the drawings.

The ring 14 and resilient gasket 16 form a trough with the side of the cylinder. The gasket is fabricated so as to form a leak-proof seal with the cylinder. As the collar moves downward along the cylinder a thin layer of the coating material 18 is deposited along the outer surface of the cylinder 10.

Figure 3:
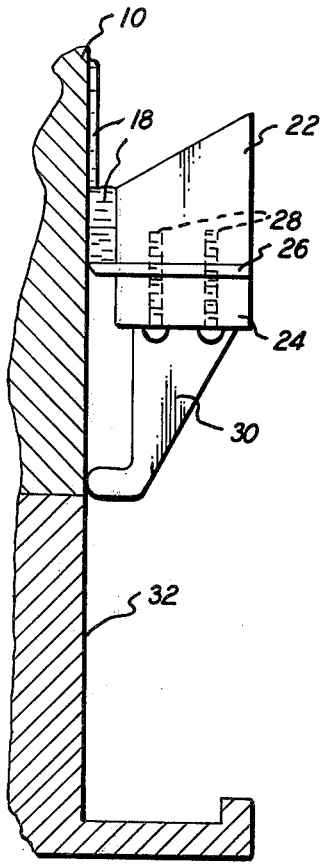

FIG. 3 depicts another embodiment of the coating collar useful in the method disclosed herein. In this embodiment, the ring of the coating collar is made up of two separate brass rings 22 and 24. The resilient gasket, which may be made of such material as polyethylene, Delrin or Teflon, is in the form of a flat ring 26 which is inserted between the two brass rings to form a sandwich which is held together by clamp screws 28. Guide finger 30 is attached to the bottom of the ring. The coating collar is normally equipped with three guide fingers spaced at 120° intervals along the ring's underside to maintain the coating collar in a perpendicular relationship with the axis of rotation of the cylinder. In FIG. 3, the cylinder is depicted as being supported by support base 32. The support base comprises a pedestal supporting a cylindrical member of the same outside diameter as the cylinder to be coated. Use of the support base enables the operator to coat the entire lateral surface of the cylinder by sliding the coating collar over the support base as it reaches the lower end of the cylinder.

For a given material, the coating thickness is a function of the solid phase dilution and the relative humidity of the ambient. Alternatively stated, the thickness depends on the viscosity and the rate of drying of the hardenable liquid material. This relationship is more fully elucidated by H. F. Payne in Ind. Eng. Chem., 1943, 15, 48 for flat plate dip coating studies and C. D. Denson in Ind. Eng. Chem., Fundam., 1970, 9, 443–8 and Trans. Soc. Rheol., 1972, 16, 697–709 on the rheology of draining films on flat surfaces.

At slow coating speeds, i.e. 12 inches per minute or less, the coating thickness varies with coating speed, with coating speed and coating thickness being in an inverse relationship. In addition, taper of the coating from the top to bottom of the cylinder can be reduced or eliminated by the use of a slow coating speed. A mechanical device comprising a constant speed drive applictor can be employed to control the linear speed of the applicator collar and thereby take advantage of the benefits of slow application. However, at higher speeds, and with typical low viscosity emulsion formulations, rapid application is possible and is extremely convenient.

It has been observed that the coating thickness of liquid emulsions will vary inversely with relative humidity. Humidity control for this process is easily achieved. A metal or plastic container with a tight-fitting lid, such as 10 gallon tall pail is lined with a sheet of blotter paper or absorbent cloth. This lining is wetted, by capillary action, with a saturated solution of a salt. Potassium bromide, for example, controls the relative humidity at 84% over a broad temperature range. Typically, the cylinder is coated with a heavy film by rapid draw-down and then immediately placed in the controlled relative humidity container to control the rate of drying, and therefore the final film thickness.

As previously mentioned, slow coating speeds are desirable in some instances and can be conveniently obtained by the use of automated coating techniques. This can be achieved by driving the collar down the cylinder via three coupled lead screws. This method will permit the slow, uniform rates needed for taper-free, extremely uniform coatings. The device can be built into a metal cabinet which will also serve to maintain a constant relative humidity. Air, pumped through a container full of saturated salt solution, can be used to supply the needed moisture.

The invention is further illustrated by the following examples.

EXAMPLE I

An electrostatographic photoreceptor comprising an aluminum cylinder, 9½ inches in diameter with a 60 $\mu$ thick layer of a selenium/arsenic alloy on its surface, is selected for coating by the process of the present invention.

A coating device comprising a 9¾ inch diameter aluminum ring with a Teflon gasket distributed internally thereto is provided. The internal diameter of the gasket is sufficiently close to the outside diameter of the cylinder to provide a snug, leak-proof fit when the coating ring is placed over the cylinder. The trough formed by the coating collar and cylinder is ⅛ inch in width.

The cylinder is positioned vertically and the coating device is slipped over its top end. About 30 milliliters of an air-setting, aqueous latex dispersion is placed in the trough formed by the cylinder, the aluminum ring and the Teflon gasket. The coating device is then pushed down the length of the cylinder smoothly and rapidly during which time a heavy film of the latex dispersion is evenly applied to the outside surface of the cylinder. At this point, the cylinder is removed to a chamber maintained at 80–85% relative humidity and allowed to drain and dry undisturbed for at least an hour.

The resulting coating is slightly tapered being about 0.5 micrometers thick at the top and about 0.7 micrometers thick at the bottom. The coating thickness will, of course, depend on the specific material being employed; the higher the viscosity the thicker the coating. Where tapering of the coating is problematical, it can be cancelled by applying two coatings in opposite directions. The coating thickness is readily measured with a reflectance spectrophotometer, and calculated using the relation:

$$d = \frac{\lambda_1 \lambda_2}{2n(\lambda_1 - \lambda_2)}$$

In the above equation, $\lambda_1$ is the wavelength of an absorption maximum (or minimum) and $\lambda_2$ is the wavelength of the adjacent maximum (or minimum); $n$ is the refractive index of the coating material and $d$ is the thickness of the coating.

EXAMPLE II

Figure 1:
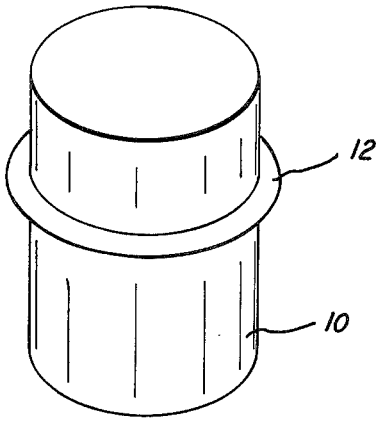
FIG. 1 represents a cylinder having a coating collar mounted on it.
Figure 2:
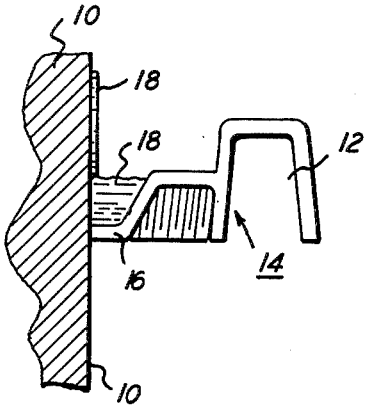
FIG. 2 depicts a one-piece coating collar in some detail.

The applicator collar for use in the present invention is prepared as follows:

The collar is fabricated from a linear polyethylene pail cover, the central portion of which is bored out on a lathe. The inside edge is sanded with 400 grit emery paper using the cylinder to be coated as a sanding block. In this manner, coating collar providing a close sliding fit with the cylinder is fabricated from one piece of starting material. This collar is of the type depicted in FIG. 2.

The collar is used to coat the cylinder as in the previous Example I.

EXAMPLE III

It is observed that with the use of low viscosity emulsion formulations, e.g. 1.8 to 6 centipoise viscosity, a rapid application is possible. In one experiment a collar containing one ounce of material is drawn down the 15 inch length of the cylinder being coated in about three seconds, depositing a fairly heavy film. After draining and drying as above, the film thickness is found to be a function of relative humidity, with films coated at 25% relative humidity being about twice as thick as films coated at 84%. These films have a taper but are found acceptable for electrostatohgraphic photoreceptor use.

What is claimed is:

1. A method for applying a thin coating of a hardenable liquid material to the surface of a cylindrical substrate which comprises:

a. mounting the cylindrical substrate in vertical disposition, on a vertically elongated pedestal having the same diameter as that of the cylinders;

b. providing an applicator collar comprising a ring having an inside diameter larger than the outside diameter of the cylinder; said ring having along its inside surface a resilient ring-shaped gasket attached to the ring in such a manner that a leakproof trough is formed when the collar is slideably mounted on the cylinder by sliding it over an end thereof and providing guide fingers depending from said ring whereby to maintain said collar in a perpendicular relationship with the cylinder axis;

c. mounting the coating collar on the outside of the cylinder by sliding it over an end thereof;

d. adding the hardenable liquid to the trough formed by the ring, gasket and cylinder while the cylinder is in a vertical position; and e. sliding the applicator collar down the full length of the cylinder and onto the pedestal to leave a thin coating of the liquid on the outer surface of the cylinder.

2. The method of claim 1 wherein the cylinder is an electrostatographic photoreceptor.

3. The method of claim 1 wherein the hardenable liquid is a latex emulsion.

4. The method of claim 1 wherein a relatively thin coating is applied by sliding the applicator down the cylinder at a rate of no greater than 12 inches per minute.

5. The method of claim 1 wherein a relatively thick coating is applied by sliding the applicator down the cylinder at a rate of greater than 12 inches per minute.

6. The method of claim 1 wherein the coated cylinder is dried in a chamber having a controlled relative humidity.

7. The method of claim 1 wherein the coating is slightly tapered and the cylinder is again coated in the opposite direction.

* * * * *